US005339142A

United States Patent [19]

Hays

[11] Patent Number: 5,339,142

[45] Date of Patent: Aug. 16, 1994

[54] AC/DC SPATIALLY PROGRAMMABLE DONOR ROLL FOR XEROGRAPHIC DEVELOPMENT

[75] Inventor: Dan A. Hays, Fairport, N.Y.

[73] Assignee: Xerox Corporation, Stamford, Conn.

[21] Appl. No.: 921,674

[22] Filed: Jul. 30, 1992

[51] Int. Cl.[5] ..... G03G 15/06

[52] U.S. Cl. ..... 355/259; 118/654; 355/249; 355/261

[58] Field of Search ..... 118/625, 647, 648, 651, 118/654, 656; 355/247, 249, 259, 261, 265

[56] References Cited

U.S. PATENT DOCUMENTS

| | | | |
|---|---|---|---|
| 3,457,900 | 7/1969 | Drexler | 118/637 |
| 3,759,222 | 9/1973 | Maksymiak et al. | 118/637 |
| 3,900,001 | 8/1975 | Fraser et al. | 118/637 |
| 3,996,892 | 12/1976 | Parker et al. | 118/658 |
| 4,078,929 | 3/1978 | Gundlach | 96/1.2 |
| 4,308,821 | 1/1982 | Matsumoto et al. | 118/645 |
| 4,478,505 | 10/1984 | Tashiro | 355/245 |
| 4,486,089 | 12/1984 | Itaya et al. | 355/251 |
| 4,568,955 | 2/1986 | Hosoya et al. | 346/153.1 |
| 4,656,427 | 4/1987 | Damphinee | 324/444 |
| 4,810,604 | 3/1989 | Schmidlin | 430/42 |
| 4,833,504 | 5/1989 | Parker et al. | 355/326 |
| 4,868,600 | 9/1989 | Hays et al. | 355/259 |
| 5,010,367 | 4/1991 | Hays | 355/247 |
| 5,031,570 | 7/1991 | Hays et al. | 118/654 |

FOREIGN PATENT DOCUMENTS 6270881 1/1987 Japan .

*Primary Examiner*—Leo P. Picard
*Assistant Examiner*—Christopher Horgan

[57] ABSTRACT

A non-interactive or scavengeless development system for use in color imaging. To control the developability of lines and the degree of interaction between the toner and receiver, an AC voltage is applied between a donor roll and electrodes supported adjacent to the surface of said donor roll to enable efficient detachment of toner from the donor to form a toner cloud. An AC voltage applied between the donor roll assembly and an image receiver serves to position the cloud in close proximity to the image receiver for optimum development of lines and solid areas without scavenging a previously toned image.

10 Claims, 3 Drawing Sheets

AC/DC SPATIALLY PROGRAMMABLE DONOR ROLL FOR XEROGRAPHIC DEVELOPMENT

BACKGROUND OF THE INVENTION

This invention relates generally to the rendering of latent electrostatic images visible. More particularly, the invention relates to non-interactive or scavengeless development systems.

The invention can be utilized in the art of xerography or in the printing arts. In the practice of conventional xerography, it is the general procedure to form electrostatic latent images on a xerographic surface by first uniformly charging a photoreceptor. The photoreceptor comprises a charge retentive surface. The charge is selectively dissipated in accordance with a pattern of activating radiation corresponding to original images. The selective dissipation of the charge leaves a latent charge pattern on the imaging surface corresponding to the areas not exposed by radiation.

This charge pattern is made visible by developing it with toner. The toner is generally a colored powder which adheres to the charge pattern by electrostatic attraction.

The developed image is then fixed to the imaging surface or is transferred to a receiving substrate such as plain paper to which it is fixed by suitable fusing techniques.

The present invention is especially suited for use in highlight color printing systems. One form, tri-level imaging, of highlight color imaging described in U.S. Pat. No. 4,078,929 issued in the name of Gundlach. The patent to Gundlach teaches the use of tri-level xerography as a means to achieve single-pass highlight color imaging. As disclosed therein the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development systems are biased to about the background voltage. Such biasing results in a developed image of improved color sharpness.

In highlight color xerography as taught in the '929 patent, the xerographic contrast on the charge retentive surface or photoreceptor is divided into three levels, rather than two levels as is the case in conventional xerography. The photoreceptor is charged, typically to −900 volts. It is exposed imagewise, such that one image corresponding to charged image areas (which are subsequently developed by charged-area development, i.e. CAD) stays at the full photoreceptor potential (Vcad or Vddp). The other image is exposed to discharge the photoreceptor to its residual potential, i.e. Vdad or Vc (typically −100 volts) which corresponds to discharged area images that are subsequently developed by discharged-area development (DAD) and the background areas exposed such as to reduce the photoreceptor potential to halfway between the Vcad and Vdad potentials, (typically −500 volts) and is referred to as Vwhite or Vw. The CAD developer is typically biased about 100 volts closer to Vcad than Vwhite (about −600 volts), and the DAD developer system is biased about 100 volts closer to Vdad than Vwhite (about −400 volts).

The viability of printing system concepts such as tri-level, highlight color xerography requires development systems that do not scavenge or interact with a previously toned image. Since commercial development systems such as conventional magnetic brush development and jumping single component development interact with the image receiver, a previously toned image will be scavenged by subsequent development. Since the present commercial development systems are highly interactive with the image bearing member, there is a need for scavengeless or non-interactive development systems.

It is known in the art to alter the magnetic properties of the magnetic brush in the second housing in order to obviate the foregoing problem. For example, there is disclosed in U.S. Pat. No. 4,308,821 granted on Jan. 5, 1982 to Matsumoto, et al, an electrophotographic development method and apparatus using two magnetic brushes for developing two-color images which allegedly do not disturb or destroy a first developed image during a second development process. This is because a second magnetic brush contacts the surface of a latent electrostatic image bearing member more lightly than a first magnetic brush and the toner scraping force of the second magnetic brush is reduced in comparison with that of the first magnetic brush by setting the magnetic flux density on a second non-magnetic sleeve with an internally disposed magnet smaller than the magnetic flux density on a first magnetic sleeve, or by adjusting the distance between the second non-magnetic sleeve and the surface of the latent electrostatic image bearing members. Further, by employing toners with different quantity of electric charge, high quality two-color images are obtained.

U.S. Pat. No. 3,457,900 discloses the use of a single magnetic brush for feeding developer into a cavity formed by the brush and an electrostatic image bearing surface faster than it is discharged thereby creating a roll-back of developer which is effective in toning an image. The magnetic brush is adapted to feed faster than it discharges by placement of strong magnets in a feed portion of the brush and weak magnets in a discharge portion of the brush.

U.S. Pat. No. 3,900,001 discloses an electrostatographic developing apparatus utilized in connection with the development of conventional xerographic images. Developer material is applied to a developer receiving surface in conformity with an electrostatic charge pattern wherein the developer is transported from the developer supply to a development zone while maintained in a magnetic brush configuration and thereafter, transported through the development zone magnetically unconstrained but in contact with the developer receiving surface.

As disclosed in U.S. Pat. No. 4,486,089 granted on Dec. 4, 1984 to Itaya, et al a magnetic brush developing apparatus for a xerographic copying machine or electrostatic recording machine has a sleeve in which a plurality of magnetic pieces are arranged in alternating polarity. Each piece has a shape which produces two or more magnetic peaks. The sleeve and the magnets are rotated in opposite directions. As a result of the above, it is alleged that a soft developer body is obtained, and density unevenness or stripping of the image is avoided.

U.S. Pat. No. 4,833,504 granted on May 23, 1989 to Parker et al discloses a magnetic brush developer apparatus comprising a plurality of developer housings each including a plurality of magnetic rolls associated therewith. The magnetic rolls disposed in a second developer housing are constructed such that the radial component of the magnetic force field produces a magnetically free development zone intermediate to a charge retentive surface and the magnetic rolls. The developer is moved through the zone magnetically unconstrained and, therefore, subjects the image developed by the first developer housing to minimal disturbance. Also, the developer is transported from one magnetic roll to the next. This apparatus provides an efficient means for developing the complimentary half of a level latent image while at the same time allowing the already developed first half to pass through the second housing with minimum image disturbance.

U.S. Pat. No. 4,810,604 granted to Fred W. Schmidlin on Mar. 7, 1989 discloses a printing apparatus wherein highlight color images are formed without scavenging and re-development of a first developed image. A first image is formed in accordance with conventional (i.e. total voltage range available) electrostatic image forming techniques. A successive image is formed on the copy substrate containing the first image subsequent to first image transfer, either before or after fusing, by utilization of direct electrostatic printing. Thus, the '604 patent solves the problem of developer interaction with previously recorded images by forming a second image on the copy substrate instead of on the charge retentive surface on which the first image was formed.

U.S. Pat. No. 4,478,505 issued on Oct. 23, 1984 relates to developing apparatus for improved charging of flying toner. The apparatus disclosed therein comprises a conveyor for conveying developer particles from developer supplying means to a photoconductive body positioned to define a gap therebetween. A developer supplying passage for conveying developer particles is provided between the developer supplying means and the gap. The developer supplying passage is defined by the conveyor and an electrode plate provided with a predetermined interval with the conveyor. An alternating electric field is applied to the developer supplying passage by an AC power source to reciprocate the developer particles between the conveyor and the electrode plate thereby sufficiently and uniformly charging the developer particles by friction. In the embodiment disclosed in FIG. 6 of the '505 patent, a grid is disposed in a space between the photosensitive layer and a donor member.

U.S. Pat. No. 4,568,955 issued on Feb. 4, 1986 to Hosoya et al discloses a recording apparatus wherein a visible image based on image information is formed on an ordinary sheet by a developer. The recording apparatus comprises a developing roller spaced at a predetermined distance from and facing the ordinary sheet and carrying the developer thereon, a recording electrode and a signal source connected thereto, for propelling the developer on the developing roller to the ordinary sheet by generating an electric field between the ordinary sheet and the developing roller according to the image information, a plurality of mutually insulated electrodes provided on the developing roller and extending therefrom in one direction, an AC and a DC source are connected to the electrodes, for generating an alternating electric field between adjacent ones of the electrodes to cause oscillations of the developer found between the adjacent electrodes along electric lines of force therebetween to thereby liberate the developer from the developing roller.

U.S. Pat. No. 4,656,427 granted to Hosaka et al on Mar. 31, 1987 discloses a method and apparatus wherein a layer of developer which is a mixture of insulative, magnetic particles and insulative toner particles is carried on the surface of a developer sleeve forming part of a magnetic brush. A latent image bearing member carrying an image to be developed is moved relative to the magnetic brush . The brush is spaced from the image bearing member and an AC field is formed across the space to effect toner transfer to the image and non-image areas and to effect a back transfer of excessive toner.

Japanese publication 62-70881 discloses a toner separating means using a plurality of electrically biased grid wires disposed intermediate a magnetic brush developer roll and an imaging surface. The two-component developer is triboelectrified and magnetic carrier is removed from the outer periphery of a sleeve by the action of the north and south poles of the magnetic poles of the magnetic brush.

U.S. Pat. No. 4,868,600 granted to Hays et al on Sep. 19, 1989 and assigned to the same assignee as the instant application discloses a scavengeless development system in which toner detachment from a donor and the concomitant generation of a controlled powder cloud is obtained by AC electric fields supplied by self-spaced electrode structures positioned within the development nip. The electrode structure is placed in close proximity to the toned donor within the gap between the toned donor and image receiver, self-spacing being effected via the toner on the donor. Such spacing enables the creation of relatively large electrostatic fields without risk of air breakdown.

U.S. Pat. No. 5,031,570 granted to Hays et al on Jul. 16, 1991 and assigned to the same assignee as the instant application discloses a scavengeless development system for use in highlight color imaging. AC biased electrodes positioned in close proximity to a magnetic brush structure carrying a two-component developer cause a controlled cloud of toner to be generated which non-interactively develops an electrostatic image. The two-component developer includes mixture of carrier beads and toner particles. By making the two-component developer magnetically tractable, the developer is transported to the development zone as in conventional magnetic brush development where the development roll or shell of the magnetic brush structure rotates about stationary magnets positioned inside the shell.

U.S. Pat. No. 4,868,600 granted to Hays et al on Sep. 19, 1989 discloses a scavengeless development system in which toner detachment from a donor and the concomitant generation of a controlled powder cloud is obtained by AC electric fields supplied by self-spaced electrode structures positioned within a development nip. The electrode structure is placed in close proximity to the toned donor within the gap or nip between the toned donor and image receiver, self-spacing being effected via the toner on the donor. Such spacing enables the creation of relatively large electrostatic fields without risk of air breakdown.

U.S. Pat. No. 5,010,367 granted to Dan A. Hays on Apr. 23, 1991 discloses a scavengeless/non-interactive development system for use in highlight color imaging. To control the developability of lines and the degree of interaction between the toner and receiver, the combination of an AC voltage on a developer donor roll with an AC voltage between toner cloud forming wires and donor roll enables efficient detachment of toner from the donor to form a toner cloud and position one end of the cloud in close proximity to the image receiver for optimum development of lines and solid areas without scavenging a previously toned image.

U.S. patent application Ser. No. 07/724,242 filed on Jul. 1, 1991 in the name of Dan A. Hays and assigned to the same assignee as the instant application discloses a scavengeless or non-interactive development system for use in image formation such as highlight color imaging. A toned donor roll structure having two sets of interdigitated electrodes physically supported by an insulative support structure is provided. Both sets of electrodes have a DC bias applied thereto while the other set has an AC bias applied thereto. The AC and DC biases are such as to preclude background development without creating fringe DC fields between adjacent electrodes.

U.S. patent application Ser. No. 07/851,411 filed on Mar. 13, 1992 in the name of Hays et al now U.S. Pat. No. 5,172,170 relates to an apparatus in which a donor roll advances toner to an electrostatic latent image recorded on a photoconductive member. A plurality of electrical conductors are located in grooves in the donor roll. The electrical conductors are spaced from one another and adapted to be electrically biased in the development zone to detach toner from the donor roll so as to form a toner cloud in the development zone. In the development zone, toner is attracted from the toner cloud to the latent image. In this way, the latent image is developed with toner.

U.S. Pat. No. 3,996,892 granted to Parker et al on Dec. 14, 1976 relates to a magnetic brush development system including a spatially programmable electrode-type applicator roll for developing latent electrostatic images carried by an imaging surface of an electrostatic processor as the imaging surface moves through a development zone which is subjected to a substantially stationary, locally generated electrostatic field having a generally uniform intensity width-wise of the imaging surface and a preselected, non-uniform intensity length-wise of the imaging surface.

A proven method of scavengeless xerographic development utilizes AC biased wires in contact with a toner layer on a donor roll. However, the wires are problematic, in that, they are difficult to mount in a consistent reproducible manner and they are prone to contamination from agglomerates or debris. Such contamination result in bands and streaks on the output copies. Furthermore, for some toner materials, the tensioned AC biased wires in self-spaced contact with the toned roll tend to vibrate which can cause nonuniform solid area development. Other toner materials cause increased toner removal at the ends of the donor roll through a snowplowing action. These problems are created by relative motion between the donor roll and the wires.

BRIEF SUMMARY OF THE INVENTION

In accordance with the present invention, electrostatic fringe fields for effecting development of latent electrostatic images are provided by an electrode structure incorporated or embedded in a donor roll.

A multiple AC voltage development system is provided in which one AC voltage applied to electrodes embedded in the donor roll near its surface establishes an AC electrostatic fringe field between the electrodes and the core of the donor roll which causes toner detachment from the donor roll yielding a cloud of a toner in a gap between the toned donor and image receiver. Another AC voltage provides an AC electrostatic fringe field across the gap between the electroded donor roll and image receiver to control the proximity of the toner cloud to the receiver. Still another AC voltage source is provided for effecting loading of toner particles from a two-component developer member such as a magnetic brush onto the surface of the donor roll. In an embodiment of the invention that utilizes single component developer (SCD), still another AC voltage is used to both charge and meter the toner particles deposited on the donor roll.

Problems created by relative motion between wire electrode structures and toned a donor roll are obviated. Furthermore, elimination of the electrode structure in the development nip obviates the need for a structure to tension and position the wire electrodes within the development nip. As will be apparent, the other problems noted above are also eliminated.

DETAILED DESCRIPTION OF THE PREFERRED EMBODIMENT OF THE INVENTION

Figure 3:
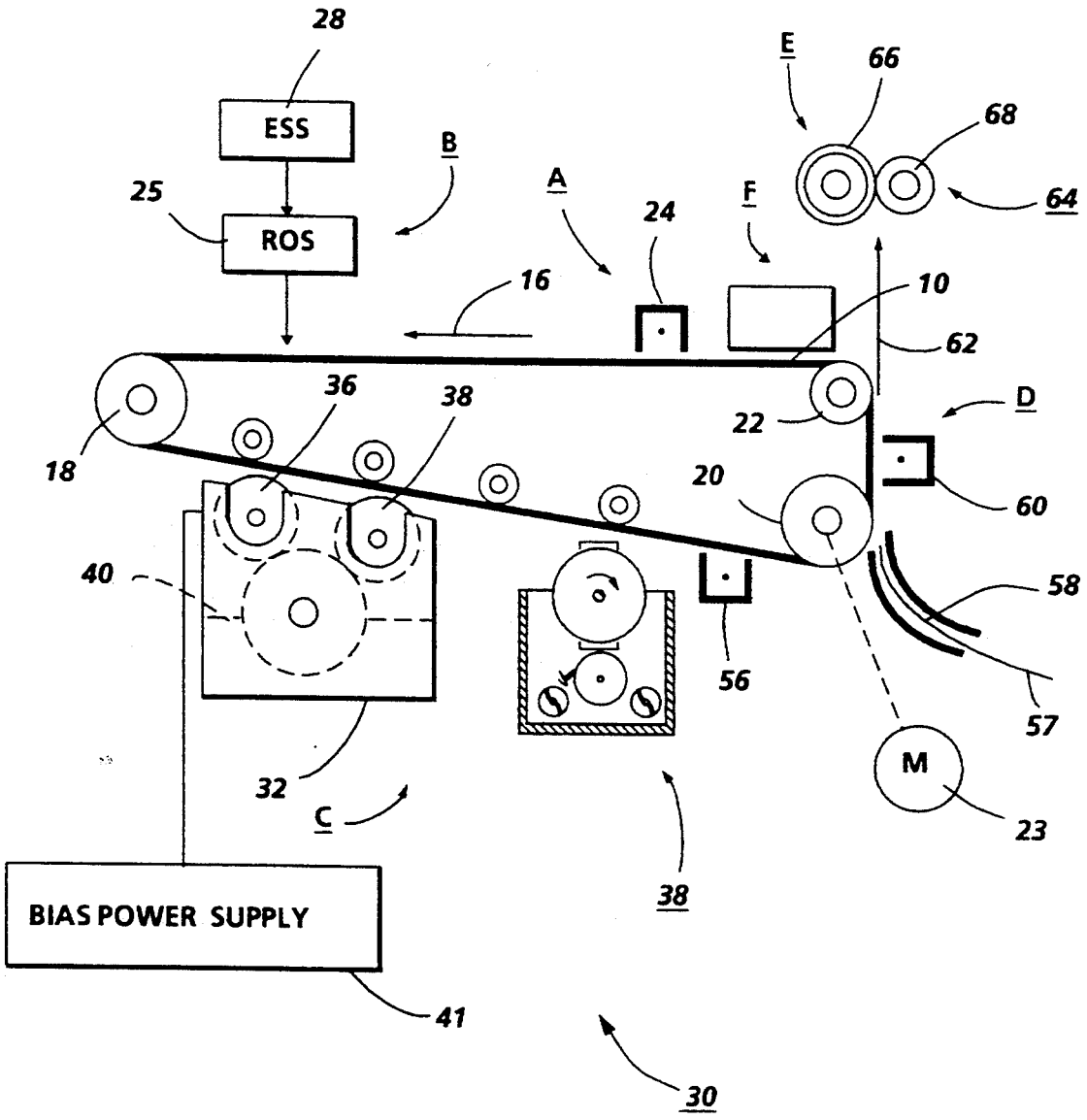
FIG. 3 is schematic illustration of a printing apparatus incorporating the inventive features of the invention

As shown in FIG. 3, a highlight color printing machine in which the invention may be utilized comprises a charge retentive member in the form of a photoconductive belt 10 consisting of a photoconductive surface 12 and an electrically conductive substrate 14 (FIG. 1) and mounted for movement past a charging station A, an exposure station B, developer station C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 20 to advance belt 10 in the direction of arrow 16. Roller 20 is coupled to motor 23 by suitable means such as a belt drive.

As can be seen by further reference to FIG. 3, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential, $V_0$. Any suitable control, well known in the art, may be employed for controlling the corona discharge device 24.

Next, the uniformly charged portions of the photoreceptor surface are advanced through exposure station B. At exposure station B, the uniformly charged photoreceptor or charge retentive surface 10 is exposed to a laser based input and/or output scanning device 26 which causes the charge retentive surface to be discharged in accordance with the output from the scanning device. Preferably the scanning device is a three level laser Raster Output Scanner (ROS). Alternatively, the ROS could be replaced by a conventional xerographic exposure device. An electronic subsystem (ESS) 28 provides for control of the ROS as well as other subassemblies of the machine.

The photoreceptor, which is initially charged to a voltage $V_0$, undergoes dark decay to a level $V_{ddp}$ equal to about −900 volts. When exposed at the exposure station B it is discharged to Vc equal to about −100 volts which is near zero or ground potential in the highlight (i.e. color other than black) color parts of the image. The photoreceptor is also discharged to $V_w$ equal to approximately −500 volts imagewise in the background (white) image areas.

At development station C, a development system, indicated generally by the reference numeral 30 advances developer material into contact with the electrostatic latent images. The development system 30 comprises first and second developer apparatuses 32 and 34. The developer apparatus 32 comprises a housing containing a pair of magnetic brush rollers 36 and 38. The rollers advance developer material 40 into contact with the latent images on the charge retentive surface which are at the voltage level $V_0$. The developer material 40 by way of example contains color toner and magnetic carrier beads. Appropriate electrical biasing of the developer housing is accomplished via power supply 41 electrically connected to developer apparatus 32. A DC bias of approximately −400 volts is applied to the rollers 36 and 37 via the power supply 41. With the foregoing bias voltage applied and the color toner suitably charged, discharged area development (DAD) with colored toner is effected.

Preferably, developer unit 34 includes a non-interactive or scavengeless developer structure including a donor roller 40 having a plurality of electrodes or electrical conductors 42 embedded therein. The electrical conductors are substantially equally spaced and located closely adjacent to the circumferential surface of donor roll 40. The electrical conductors 42 are electrically biased in the development zone to detach toner from donor roll 40. In this way, a toner powder cloud is formed in the gap between donor roll 40 and photoconductive belt 10. The latent image recorded on photoconductive belt 10 attracts toner particles from the toner powder cloud forming a toner powder image thereon. Donor roller 40 is mounted, at least partially, in a chamber 43 of developer housing 44. The chamber in developer housing 44 stores a supply of developer material. The developer material is a two-component developer material of at least carrier granules having toner particles adhering triboelectrically thereto. A magnetic roller 46 disposed interiorly of the chamber of housing 44 conveys the developer material to the donor roller. The magnetic roller is electrically biased relative to the donor roller so that the toner particles are attracted from the magnetic roller to the donor roller at a loading zone. Developer unit 34 will be discussed hereinafter, in greater detail, with reference to FIG. 1.

With continued reference to FIG. 3, after the electrostatic latent image is developed, belt 10 advances the toner powder image to transfer station D. A copy sheet 57 is advanced to transfer station D by sheet feeding apparatus, not shown. Preferably, sheet feeding apparatus includes a feed roll contacting the uppermost sheet of a stack of sheets. The feed roll rotates to advance the uppermost sheet from stack into chute 58. Chute 58 directs the advancing sheet of support material into contact with photoconductive surface of belt 10 in a timed sequence so that the toner powder image developed thereon contacts the advancing sheet at transfer station D. Transfer station D includes a corona generating device 60 which sprays ions onto the back side of sheet 57. This attracts the toner powder image from photoconductive surface 10 to sheet 57. After transfer, sheet 57 continues to move in the direction of arrow 62 onto a conveyor (not shown) which advances sheet 57 to fusing station E.

Fusing station E includes a fuser assembly, indicated generally by the reference numeral 64, which permanently affixes the transferred powder image to sheet 57. Fuser assembly 64 includes a heated fuser roller 66 and back-up roller 68. Sheet 57 passes between fuser roller 66 and back-up roller 68 with the toner powder image contacting fuser roller 66. In this manner, the toner powder image is permanently affixed to sheet 57. After fusing, sheet 57 advances through a chute, not shown, to catch tray, also not shown, for subsequent removal from the printing machine by the operator.

After the copy sheet is separated from photoconductive surface of belt 10, the residual toner particles adhering to photoconductive surface of belt 10 are removed therefrom at cleaning station F. Cleaning station F may include a rotatably mounted fibrous brush, not shown, in contact with photoconductive surface 12. The particles are cleaned from photoconductive surface 12 by the rotation of the brush in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the developer unit of the present invention therein.

Figure 1:
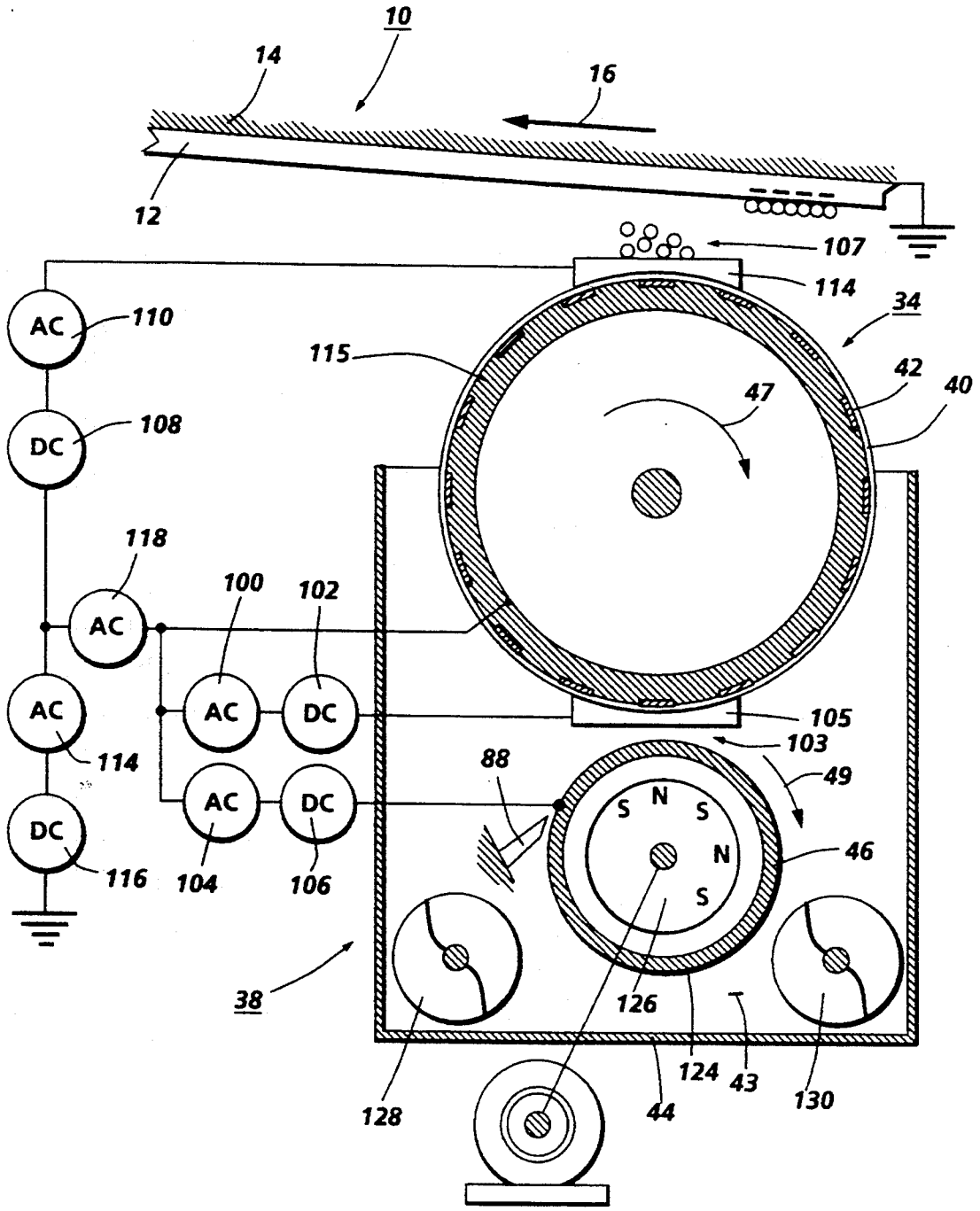
FIG. 1 is a schematic elevational view of a development apparatus according to the invention.

Reference is now made to FIG. 1, where the developer unit 34 is shown in greater detail. As illustrated, developer unit 34 includes the housing 43 defining the chamber 44 for storing a supply of developer material therein. Donor roll 40 has electrical conductors 42 positioned about the peripheral circumferential surface thereof. The electrical conductors are substantially equally spaced from one another and insulated from the body 115 of donor roll 40 which is electrically conductive. Donor roll 40 rotates in the direction of arrow 47. The magnetic roller 46 is also mounted in chamber 43 of developer housing 44. Magnetic roller 46 is shown rotating in the direction of arrow 49.

An alternating voltage source 100 and a constant voltage source 102 electrically bias the magnetic brush roll 46 in a toner loading and reloading zone 103 between the donor roll 40 and the magnetic roller 46. This arrangement of electrically biases provides efficient toner loading and reloading of toner on the donor roll 40. The strong fringe electric fields associated with these voltages provide additional electrostatic forces in the toner reload zone. The magnetic roller 46 is electrically biased via AC voltage source 104 and DC voltage source 106. The relative voltages between donor roll 40 and magnetic roller 46 are selected to provide efficient loading of toner on donor roll 40 from the carrier granules adhering to magnetic roller 46.

In a development zone 107, an AC voltage sources 108 and a DC voltage source 110 electrically bias isolated electrical conductors 42. As donor roll 40 rotates in the direction of arrow 47, successive electrodes 42 advance into the development zone 107. As shown in FIG. 1, a wiping commutator in the form of a brush 114 simultaneously contacts the electrodes 42 in development zone 107 and is electrically connected to voltage sources 108 and 110. In this way, an AC voltage is applied between the isolated electrical conductors and the donor roll for effecting detachment of toner from the donor roll yielding a toner powder cloud. In general, the DC voltage 108 can be set at an optimum bias that will depend upon the toner charge, but usually this voltage is set at zero.

The electroded donor roll assembly has a metal core or support 115 upon which the electrodes 42 are carried. The core 115 is biased by voltage sources 114, 16 and 118. DC voltage source 116 controls the DC electric field between the electroded donor roll assembly and photoconductive belt 10 for the purpose of suppressing background deposition of toner particles. The AC voltage 114 applied to the core 115 serves to establish an AC electrostatic field between the electroded donor roll and the image receiver or photoconductive belt 10. For a particular toner and gap setting between the donor and receiver, the amplitude and frequency can be selected to position the toner cloud in close proximity to the receiver to enable the development of an electrostatic image consisting of fine lines and dots. Furthermore, under these conditions, one can obtain scavengeless or non-interactive development for single-pass color system concepts.

AC voltage source 118 also applies an AC voltage to the core of donor roll 40 for the purpose of applying an AC electrostatic field between the core of the donor roll and conductors 42, as well as between the donor roll and photoconductive belt 10. Although either of the AC voltages 118 and 110 could be zero, one of the voltages must not be zero so that a toner cloud can be formed in the development zone. For a particular toner and gap in the development zone between the donor roll and photoconductive belt, the amplitude and frequency of the AC voltage being applied on donor roll 40 by AC voltage supplies 110, 114 and 118 can be selected to position the toner powder cloud in close proximity to the photoconductive surface of belt 10, thereby enabling development of an electrostatic latent image consisting of fine lines and dots.

A wiping brush 105 engages donor roll 40 in loading zone 103. This insures that the donor roll is appropriately electrically biased relative to the electrical bias applied to the magnetic roller 46 in loading zone 103 so as to attract toner particles from the carrier granules on the surface of magnetic roller 46.

Magnetic roller 46 advances a constant quantity of toner having a substantially constant charge onto donor roll 40. This insures that donor roller 40 provides a constant amount of toner having a substantially constant charge in the development zone. Metering blade 122 is positioned closely adjacent to magnetic roller 46 to maintain developer material on magnetic roller 46 at the desired level. Magnetic roller 46 includes a non-magnetic tubular member 124 made preferably from aluminum and having the exterior circumferential surface thereof roughened. An elongated magnetic 126 is positioned interiorly of and spaced from the tubular member. The magnet is stationarily mounted. The tubular member rotates in the direction of arrow 49 to advance the developer material adhering thereto into the loading zone 103. In loading zone 103, toner particles are attracted from the carrier granules on the magnetic roller to the donor roller. Augers 128 and 130 are mounted rotatably in chamber 41 to mix and transport developer material. The augers have blades extending spirally outwardly from a shaft. The blades are designed to advance the developer material in the direction substantially parallel to the longitudinal axis of the shaft.

As successive electrostatic latent images are developed, the toner particles within the developer material are depleted. A toner dispenser (not shown) stores a supply of toner particles. The toner dispenser is in communication with chamber 43 of housing 44. As the concentration of toner particles in the developer material is decreased, fresh toner particles are furnished to the developer material in the chamber from the toner dispenser. The auger and the chamber of the housing mix the fresh toner particles with the remaining developer material so that the resultant developer material therein is substantially uniform with the concentration of toner particles being optimized. In this way, a substantially constant amount of toner particles are in the chamber of the developer housing with the toner particles having a constant charge. The developer material in the chamber of the developer housing is magnetic and may be electrically conductive. By way of example, the carrier granules include a ferro-magnetic core having a thin layer of magnetite overcoated with a non-continuous layer of resinous material. The toner particles are made from a resinous material, such as a vinyl polymer mixed with a coloring material, such as chromogen black. The developer material comprises from about 95% to about 99% by weight of carrier and from 5% to about 1% by weight of toner. However, one skilled in the art will recognize that any other suitable developer material may be used.

Figure 2:
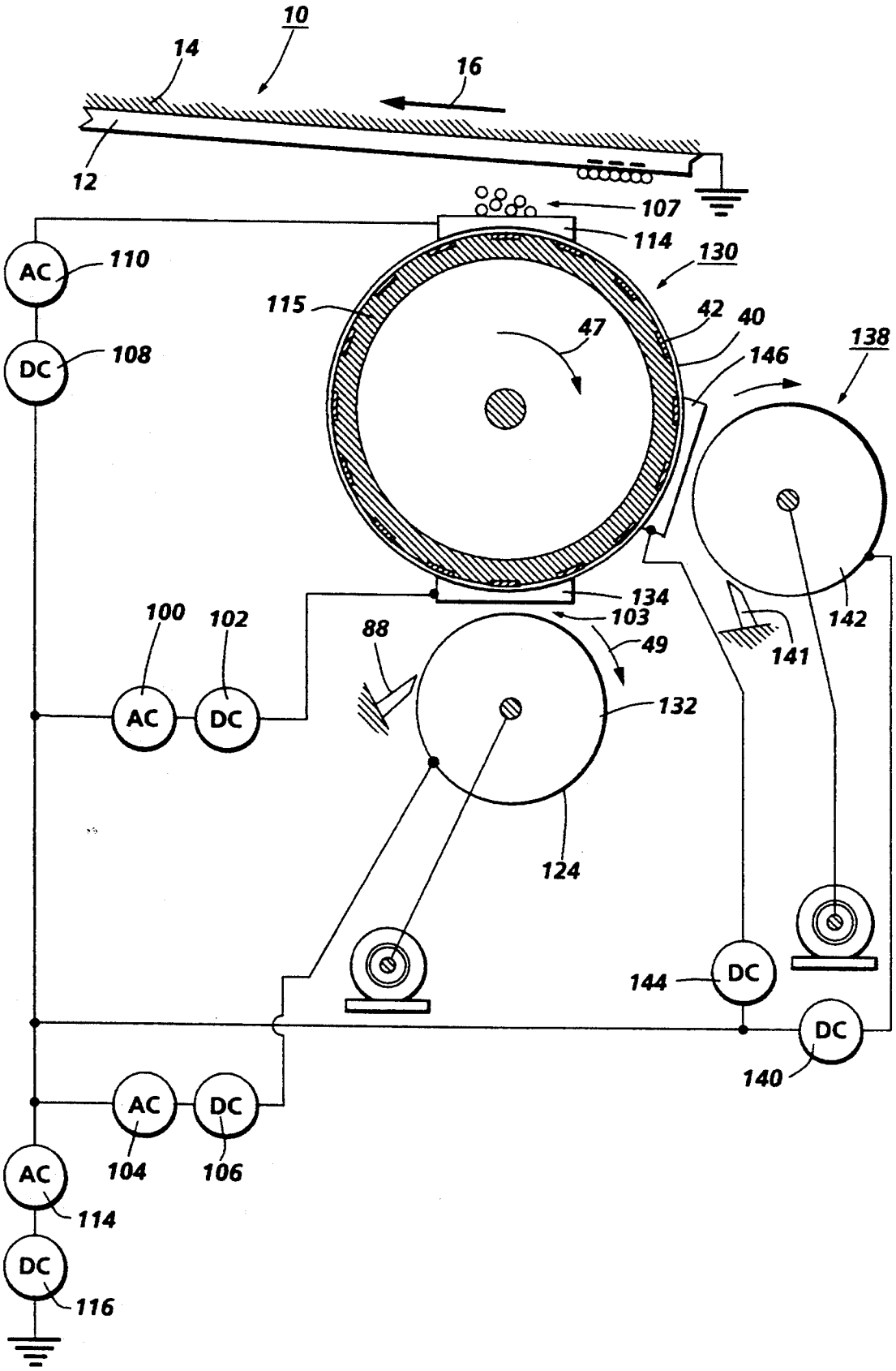
FIG. 2 is a schematic elevational view of another embodiment of a development apparatus according to the invention.

A modified form of the invention as illustrated in FIG. 2, utilizes a single component developer (SCD) system 130. The same reference characters are used to identify members of the embodiment of FIG. 2 which are the same as those of FIG. 1.

For donor roll systems, the bias 102 of the same polarity as the desired toner charge is applied to a toner mover 132 relative to the donor roll to help load toner of the desired polarity on the donor. Opposite polarity toner is deposited on the toner mover which is usually removed with a blade. With an electroded donor 40, several combinations of applying 104/106 biases to the toner mover and 100/102 biases to a commutator brush 134 in the reload zone can can be used to aid loading and reloading of toner on the donor. One combination is to only apply a voltage 100 while 102, 104 and 106 are set at zero. The AC fringe field would simultaneously load both positively and negatively charged toner. Removal of both polarities of toner charge in the sump improves the toner loading and flow properties.

Since both polarities of toner charge are deposited on the donor, the toner must be triboelectrically charged to the desired amount as it is rubbed with the donor 40 and a metering/charging arrangement 138. A bias 140 helps to electrostatically remove the wrong sign toner. The removal of wrong-sign toner with a scraper blade contacting a rotating metering/charging rod 142 makes toner with an average charge of zero since there will be air breakdown as the toner collects at the edge of the blade. A bias DC 144 operatively connected to a commutator brush 146 is set at zero for most situations. Although FIG. 2 shows a rotating metering/charging member, it is understood that a metering/charging blade either in the wiper or overhung doctor blade mode can also be used to provide the toner metering/-charging function.

What is claimed is:

1. Apparatus for forming images on an image receiving surface with developer, said apparatus comprising:

a supply of single component uncharged toner;

a moving donor member including a plurality of spaced apart electrodes closely adjacent the surface thereof for transporting developer from said supply to a development zone adjacent said image receiving surface;

means for loading toner particles onto said donor member, said loading means comprising means for applying a voltage to some of said electrodes in a loading zone;

means for charging said toner after its loading on said donor member;

means operatively associated with selected ones of said electrodes for forming transported toner into a cloud of marking particles in said development zone;

means for controlling the spacing of said cloud of marking particles relative to said image receiver without strongly interacting with said image receiving surface.

2. Apparatus according to claim 1 wherein said means operatively associated with said electrodes comprises an AC/DC voltage source and means for applying said voltage to selected electrodes in said development zone.

3. Apparatus according to claim 2 wherein said means for controlling the spacing of said marking particle cloud comprises an AC bias voltage applied between said donor member and said image receiving surface.

4. Apparatus according to claim 1 further including electrical biasing means for removing wrong sign toner from said donor member.

5. Apparatus according to claim 4 wherein only some of said electrodes are used for removing wrong sign toner from said donor member.

6. Method for forming images on an image receiving surface with developer, said method including the steps of:

providing a supply of single component uncharged toner;

loading toner particles onto a donor member having a plurality of spaced apart electrodes closely adjacent a surface thereof by applying a voltage to some of said electrodes in a loading zone;

using said donor member including a plurality of spaced apart electrodes closely adjacent the surface to transport developer from said supply to a development zone adjacent said image receiving surface;

charging said toner after loading it on said donor member;

using only some of said electrodes, forming transported toner into a cloud of marking particles in said development zone; and controlling the spacing of said cloud of marking particles relative to said image receiver without strongly interacting with said image receiving surface.

7. The method according to claim 6 wherein said forming step comprises an AC/DC voltage source and means for applying said voltage to selected electrodes in said development zone.

8. The method according to claim 7 wherein said step of controlling the spacing of said marking particle cloud comprises using an AC bias voltage applied between said donor member and said image receiving surface.

9. The method according to claim 6 including the step of removing wrong sign toner from said donor member.

10. The method according to claim 9 wherein the step of removing wrong sign sign toner is effected by applying an electrical bias to only some of said electrodes.

* * * * *